United States Patent [19]

Gauche, deceased et al.

[11] 3,977,343

[45] Aug. 31, 1976

[54] FUEL INJECTION PUMP REGULATING DEVICE

[75] Inventors: Claude Gauche, deceased, late of Lyon, France, by Michele Gauche nee Lelandais, administratrix

[73] Assignee: Sigma Diesel, Venissieux, France

[22] Filed: Mar. 17, 1975

[21] Appl. No.: 558,646

[30] Foreign Application Priority Data

Mar. 19, 1974 France ..... 74.09329

[52] U.S. Cl. ..... 123/140 R; 123/140 A; 74/110

[51] Int. Cl.[2] ..... F02D 1/04; F02D 1/06

[58] Field of Search ..... 123/140 R; 308/330

[56] References Cited

UNITED STATES PATENTS

| | | | |
|---|---|---|---|
| 2,401,558 | 6/1946 | Edwards | 123/140 R |
| 3,915,140 | 10/1975 | Parks | 123/140 R |

*Primary Examiner*—Charles J. Myhre
*Assistant Examiner*—Ronald B. Cox
*Attorney, Agent, or Firm*—Larson, Taylor and Hinds

[57] ABSTRACT

A device for regulating the delivery per revolution of an internal combustion fuel injection pump comprises a pusher movable by a governor responsive to the engine speed, a sleeve connected to a control rod for adjusting the pump delivery and means operatively coupling the pusher and the sleeve. The latter means comprise a retaining element on which the sleeve is slidable and which has an inclined surface, balls disposed between the inclined surface of the retaining element and an inclined surface of the pusher, the two inclined surfaces converging in a direction parallel to the pusher axis. The retaining element is adapted to engage at one end with a resilient abutment associated with the governor, and an entraining member which moves with the sleeve is provided for transmitting axial movements of the balls to the sleeve.

12 Claims, 3 Drawing Figures

FUEL INJECTION PUMP REGULATING DEVICE

BACKGROUND OF THE INVENTION

This invention relates to a device for regulating the delivery per revolution of an in-line fuel injection pump which is adapted to supply an internal combustion engine and which comprises a longitudinally slidable control rod movable under the control of a governor responsive to the engine speed, said device being of the kind comprising a pusher movable by the governor in response to engine speed variations, a sleeve connected to the control rod, means operatively connecting the pusher and the sleeve together, and resilient abutment means associated with the governor.

Regulating devices of this kind, which serve to vary the value of the delivery of the fuel injection pump in dependence upon the speed of the engine are known. In particular, devices for acting on the pump delivery at low pump speeds, so as to reduce the formation of smoke while making it possible to produce a high driving torque at the rated speed, are known.

SUMMARY OF THE INVENTION

It is an object of the invention to improve the practical performance of such regulating devices, inter alia to simplify their construction and reduce their size.

According to the invention, in a regulating device of the kind specified, the means operatively connecting the pusher and the sleeve together comprise: a retaining element on which the sleeve can slide freely and which has a surface at an inclination to the pusher axis; and rolling elements which are disposed between the inclined surface of the retaining element and a pusher surface which is at an inclination to the axial direction of the pusher, the inclined surfaces of the retaining element and pusher converging in a direction parallel to the pusher axis; and means for transmitting axial movements of the rolling elements to the sleeve; the resilient abutment means being adapted to engage at one end, either directly or indirectly, with the retaining element.

Advantageously, the inclined surfaces of the retaining elements and pusher take the form of surfaces of revolution around an axis common to the pusher and retaining element.

Advantageously, the retaining element takes the form of a dished member with its concavity near the pusher, the dished member being adapted to bear on a cup urged towards an axial abutment by at least some of the resilient means.

Preferably, the rolling elements are balls.

If such inclined surfaces are surfaces of revolution and the rolling elements are balls disposed between them, the pusher can be rotated with the centrifugal governor but the dished retaining element and the sleeve are not rotated, in which event a ball bearing is interposed between the sleeve and the pusher, such ball bearing also being slidable on the pusher.

Preferably, the means for transmitting axial movements of the rolling elements to the sleeve take the form of an entraining member which moves with the sleeve and bears axially at one end on the rolling elements.

Advantageously, if a rolling bearing is disposed between the sleeve and the pusher, the entraining member takes the form of a sleeve which can slide freely on the pusher and which carries the inner race of the ball bearing.

Advantageously, the pusher is in the form of a hollow tubular member receiving a rod located axially of such member, a spring, inter alia a helical spring, being disposed in the pusher and bearing at one end on a cup located axially on the last-mentioned rod and bearing at its other end on a crosspiece having arms extending through apertures in the pusher, the crosspiece arms bearing axially on the means for transmitting axial movements, inter alia the means embodied by the entraining member.

The generatrices of the inclined surface of the retaining element converge at a first point remote from the governor, and the generatrices of the pusher inclined surface can converge either towards a second point which is also remote from the governor but further away than the first point or towards a third point which is disposed near the governor, according to the kind of regulation required.

As a rule, the inclined surface of the pusher has a frusto-conical shape but it can be differently shaped, inter alia like a diabolo or a barrel. As a rule, the surface of the entraining member is plane but it can have a different shape. A regulating device of this kind is suitable for both an all-speed governor and for a minimum-maximum governor.

The invention also relates to injection pumps having a regulating device of the kind hereinbefore defined.

BRIEF DESCRIPTION OF THE DRAWING

In addition to the features hereinbefore set forth the invention comprises other features which will be described in greater detail hereinafter with reference to a nonlimitative and preferred embodiment to be described in detail with reference to the accompanying drawing wherein.

DESCRIPTION OF PREFERRED EMBODIMENT

Figure 1:
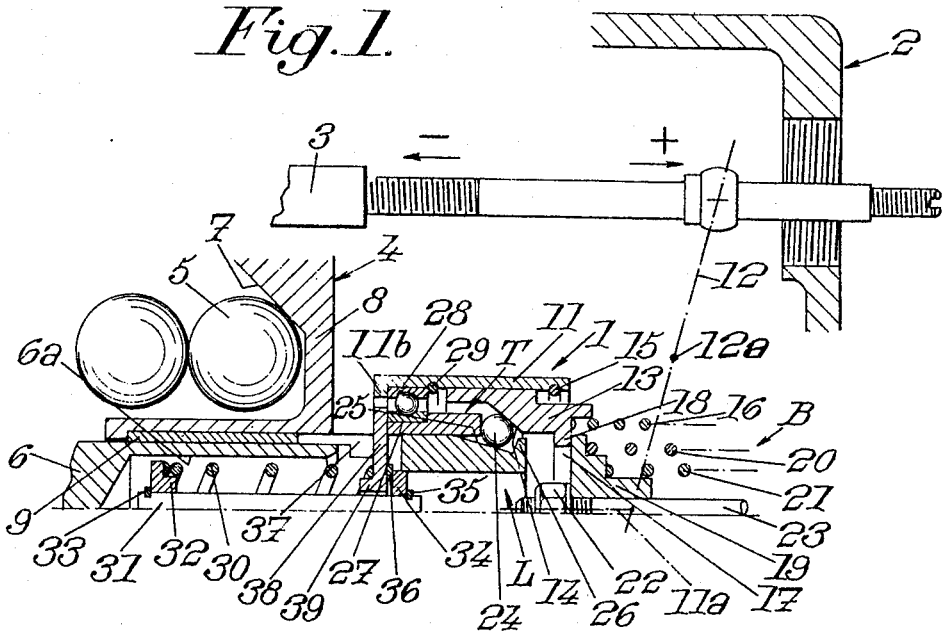
FIG. 1 is a view in axial half-section of a regulating device according to the invention.

Referring to FIG. 1, there can be seen a device 1 for regulating the delivery per revolution of a fuel injection pump 2, the latter being represented in diagrammatic form by a part of its casing. The injection pump is adapted to supply an internal combustion engine (not shown) with fuel.

The injection pump 2 is of the in-line kind — i.e., it comprises a number of cylinders and pistons whose axes are parallel to one another and all disposed in the same plane, the pistons being connected to a longitudinally slidable control rod or rack 3. The hydraulic section of the pump 2 comprises metering piston and cylinder means and is conventional; of course, in a pump of this kind the quantity of fuel injected per piston stroke depends upon the angular position of the pistons relatively to the associated cylinders. The angular positions of the pistons are controlled accurately by the control rod or rack 3.

The delivery of the pump is controlled by a governor 4 which is sensitive to the speed of the engine supplied by the pump and which is, with advantage, of the kind having centrifugal bobweights 5 and which is disposed on a shaft 6 rotated by the engine. Control rod 3 is disposed parallel to the axis of shaft 6. As the speed of rotation increases, the bobweights 5 tend to move away from the axis of shaft 6 and, in co-operation with an inclined surface 7 of a sleeve 8, apply thereto a force tending to move it axially — to the right in FIG. 1. Sleeve 8 is rotated by shaft 6 with or without slip but is free to be displaced relative to shaft 6.

The regulating device 1 comprises a sleeve-like pusher 9 disposed around shaft 6 and in turn having around it the sleeve 8, to which pusher 9 is rigidly secured.

A sleeve 11 which is coaxial with shaft 6 is connected to rod 3, either rigidly or by way of a member 11*a* and a bell crank lever 12 pivoted to a pivot 12*a*, shown diagrammatically in chain-dotted lines. Means L for connecting pusher 9 to sleeve 11 are provided between the same. Resilient abutment or stop means B are associated with the governor 4 and their arrangement will be described in greater detail hereinafter.

The connecting means L between the pusher 9 and sleeve 11 comprises a retaining element 13 having a surface 14 which is at an inclination to the pusher axis. Sleeve 11 is free to slide on element 13. A circlip or gasket 15 is secured in a groove at that end of sleeve 11 which is remote from sleeve 8 to serve as an abutment for element 13 when the sleeve 11 moves relatively to the element 13 in the direction of the sleeve 8.

Advantageously, element 13 takes the form of a dished body of revolution whose concavity faces pusher 9 and whose inclined surface 14 is a surface of revolution, preferably a frusto-conical surface. A spring 16 which is associated with the means B and which is usually known as an excess-charge spring bears directly at one end on that part of the member 13 which is remote from sleeve 8. Member 13 is formed with an axial aperture 17 having at its edge a shoulder 18 which projects radially inwards. Shoulder 18 is adapted to bear on a cup 19 biased by helical springs 20, 21 forming part of the means B towards an axial abutment 22 such as a nut screwed on the end of a rod 23 carried by casing 2.

The device 1 also comprises rolling elements which are, with advantage, in the form of balls 24 disposed between the inclined surface 14 of the cup 13 and a surface 25 which is at the end of pusher 9 and which is at an inclination to the axis thereof. Advantageously, the surface 25 is a surface of revolution around the pusher axis. The two inclined surfaces 14, 25 converge in a direction parallel to the pusher axis. In the example shown in FIGS. 1 and 2, the surface 25 is frusto-conical and convex; the generatrices of the two surfaces 14, 25 converge in the direction extending away from the sleeve 8. The generatrix of surface 14 converges towards a first point on the axis which is remote from the governor and the generatrix of the surface 25 converges towards a second point on the axis which is also remote from the governor but further away therefrom than the first point.

The pusher surface 25 can be of some other shape, such as a diabolo shape arising from two frusto-conical surfaces sharing a minor base, or the shape of a barrel. As a rule, the shape of the surface 25 depends upon the kind of regulation which it is required to provide for the pump delivery in dependence upon pump speed. The surface 25 can have a generatrix converging towards a third point which is disposed near the governor.

The end of the pusher remote from sleeve 8 terminates in a shoulder 26 which projects radially outwards.

The regulating device 1 also comprises means T for transmitting the axial movements of the balls 24 to the sleeve 11. The term "axial movements of the balls 24" denotes those components of the movements of the balls 24 which lie in the axial direction of the pusher 9. Preferably, the means T comprises an entraining member 27 in the form of a sleeve freely slidable on pusher 9 and displaceable with sleeve 11. Member 27 bears axially at one end — the right-hand end in the drawings — on the balls 24.

Sleeve 11 is disposed around entraining member 27 with the interposition of a ball bearing 28 whose outer race is located on sleeve 11 between a shoulder 11*b* at that end of sleeve 11 which is near sleeve 8, and a circlip 29 disposed in a groove in the inner wall of sleeve 11. The inner race of bearing 28 is fixed in member 27. Clearly, the subassembly comprising the parts 27, 28 and 11 can slide as a unit on the parts 13 and 9.

A helical spring 30 retains the member 27 in engagement with the balls 24. Spring 30, which is coaxial with pusher 9, is partly received in a blind bore 6*a* at the end of shaft 6 and is located around a rod 31, one end of which is positioned inside aperture 6*a* and has a cup 32 located axially on rod 31 by a circlip 33 secured therein. Spring 30 bears on cup 32 and urges the same against circlip 33. At its other end which extends out of the blind bore 6*a* but which is disposed in pusher 9, rod 31 carries a disc or washer or the like 34 which is adapted to centre rod 31 in the bore of pusher 9 and which is located on rod 31 by a circlip 35 secured therein. Another circlip 36 which is secured in the inner wall of pusher 9 and which is disposed near the shaft 6 relatively to the disc 34 is provided as an abutment for the disc 34.

Pusher 9 is formed with two apertures 37 which are disposed diametrically opposite one another and which are adapted to receive the two arms 38 of a crosspiece 39 introduced inclinedly into pusher 9 and mounted for sliding on rod 31. The other end of spring 30 bears on crosspiece 39. The arms 38 thereof bear on that end of the entraining member 27 which is remote from the balls 24.

Before the delivery regulation which it is the function of the device 1 to provide commences, the crosspiece 39 is in abutting engagement with that surface of circlip 36 which is near shaft 6, as shown in FIG. 1. In an arrangement of this kind, that end of spring 30 which bears on cup 32 is so connected to pusher 9 as to be displaced therewith. That part of pusher 9 which is disposed in sleeve 8 is cylindrical and receives the rotary and translational movement of the sleeve 8 of the governor 4.

The governor can be of the "all-speed" or "minimum-maximum" kind. In the case of an "all-speed" governor, the resilient abutment means B bear, at that end (not visible in FIG. 1) which is remote from cup 19 on another cup adapted to be moved axially be an accelerator lever so that the stressing of the means B can be modified. In the case of a minimum-maximum governor the accelerator does not act on such a cup but alters the characteristics of the connection between the sleeve 11 and the control rod 3.

The regulating device according to the invention therefore operates as follows:

Briefly, the delivery of injected fuel depends upon the longitudinal position of the control rod 3 connected to the sleeve 11. When rod 3 is rigidly connected to sleeve 11, the quantity of fuel injected decreases for a movement of rod 3 to the right and vice versa. When rod 3 is connected to sleeve 11 by way of a bell crank 12 as shown in FIG. 1, the delivery of injected fuel decreases for a movement of rod 3 to the left and vice versa. In both cases there is a decrease in the quantity of fuel injected when the sleeve 11 moves to the right in FIG. 1, and an increase in delivery when sleeve 11 moves to the left in FIG. 1.

When the engine is at a standstill, spring 16 keeps the dished member 13 away from the cup 19 and rod 3 is in the excess-charge position giving a high rate of flow or delivery suitable for starting the engine. When the engine starts to turn, the action of the centrifugal governor 4 cuts out the excess charge by acting on the regulating device 1, including the dished member 13, until the same bears on cup 19. This position, which is shown in FIG. 1, corresponds to the position of rated delivery or "full-load delivery" before regulation.

The excess charge is eliminated without any relative movement between the various elements of the corrector 1 since the initial tension of spring 30 is greater than the forces developed by the excess-charge spring 16. As engine speed increases the force developed by the bobweights 5 is transmitted to the pusher 9. When the latter force is sufficient to overcome the force of spring 30, pusher 9 moves relatively to member 13 which has abutted cup 19, the same being located on abutment 22 by the springs 20, 21.

Figure 2:
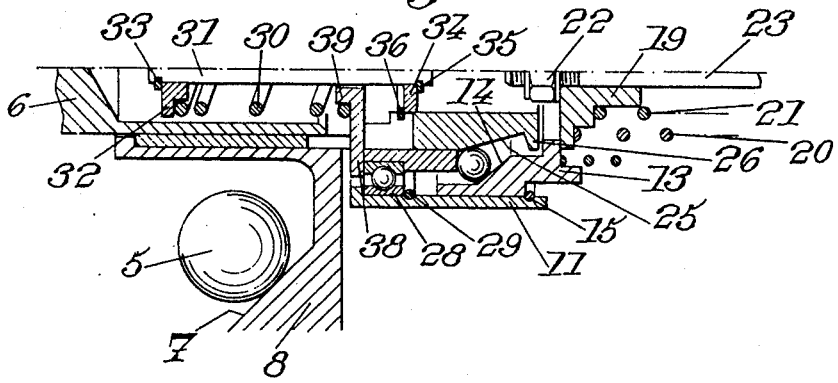
FIG. 2 shows the same device as in FIG. 1 but with its constituent parts in a different relative position.

When the pusher 9 and dished member 13 make this relative movement, the result of the inclined, i.e. frusto-conical, surfaces 25 and 14 is that the balls 24 shift and make a movement having an axial component. In the case shown in FIG. 1, since the inclined surfaces 25, 14 converge in the direction away from shaft 6, when pusher 9 moves towards dished member 13 the balls 24 rise against the surface 14 and thus move away axially from shoulder 18 of member 13 and move axially towards shaft 6. This axial movement of the balls 24 is transmitted to sleeve 11 by the entraining member 27. Consequently, a rightward movement of pusher 9 in the drawing produces a leftward movement of the sleeve 11 relative to the axially located dished member 13 — i.e., a movement corresponding to an increase in the delivery per revolution. The corresponding end-of-regulation position arises when the sleeve 11 abuts the member 13 by way of circlip 15; such position is shown in FIG. 2.

The delivery variation introduced by the regulating device 1 in dependence upon engine speed depends upon the characteristics of spring 30. The pattern of the delivery variation thus introduced depends upon the shape of the inclined surface 25 and/or of the inclined surface 14. The regulation can be negative as shown — i.e., an increase in engine speed in the regulation range increases the delivery per revolution. A positive regulation could equally be provided. If the surfaces are diabolo-shaped or barrel-shaped, a negative and positive regulation can be provided or the converse.

Figure 3:
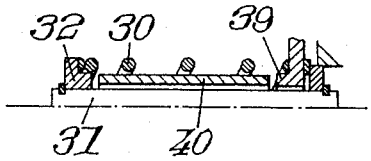
FIG. 3 shows an alternative embodiment of part of the regulating device.

The range of regulation can be adjusted by means of a set of shims (not shown) disposed between the member 13 and the circlip 15 in the sleeve 11. Another way of adjusting the regulation range is to provide a cross-member 40 (visible in FIG. 3) between the cup 32 and the crosspiece 39.

When engine speed becomes high enough for the centrifugal governor to overcome the force of the springs 16, 20, 21, the whole system moves to the right in the drawing and reduces the injection delivery right down to zero (the zero position is not shown).

The regulating device according to the invention is of simple and rugged construction and takes up little space and can readily be devised to provide regulation in accordance with a very wide variety of patterns.

The regulating device is also independent of other governor parameters such as cut-out speed, or the like.

I claim:

1. A device for regulating the delivery per revolution of an in-line fuel injection pump which is adapted to supply an internal combustion engine and which comprises a longitudinally slidable control rod movable under the control of a governor responsive to the engine speed, said device comprising a pusher movable by the governor in response to engine speed variations, a sleeve connected to the control rod, means operatively connecting said pusher and said sleeve, and resilient abutment means associated with the governor, said device being characterised by said pusher having a pusher surface which is inclined to the axial direction of said pusher and by said means operatively connecting the pusher and the sleeve comprising a retaining element on which said sleeve is freely slidable and which has a surface inclined to the pusher axis and convergent with said pusher surface, rolling elements which are disposed between said inclined surface of said retaining element and said pusher surface, and means for transmitting axial movements of said rolling elements to said sleeve, said resilient abutment being adapted to co-operate at one end with said retaining element.

2. A device according to claim 1, wherein said pusher is in the form of a hollow tubular member having apertures therein, said device further comprising a rod received in said pusher and located axially of said pusher, a cup located axially on said rod, a crosspiece having arms extending through said apertures in said pusher so as to bear axially on said means for transmitting axial movements of said rolling elements to said sleeve, and a spring disposed in said pusher and bearing at one end on said cup and the other end on said crosspiece.

3. A device according to claim 2, wherein said rod is located axially of said pusher by means of a ring secured to the inner surface of said pusher.

4. A device according to claim 2 for an injection pump comprising a centrifugal governor having a governor sleeve slidable on a drive shaft by centrifugal bobweights, wherein said pusher has a cylindrical portion disposed radially between said governor sleeve and said drive shaft, said governor sleeve being rigidly secured to said pusher so as to move said pusher axially.

5. A device according to claim 1 wherein said means for transmitting axial movements of said rolling elements to said sleeve take the form of an entraining member which moves with said sleeve and bears axially at one end on said rolling elements.

6. A device according to claim 5 wherein a rolling bearing is disposed between said sleeve and said pusher, and said entraining member has the form of a sleeve which can slide freely on the pusher and which carries the inner race of said rolling bearing.

7. A device according to claim 1, wherein said inclined surface of said retaining element and said pusher surface are surfaces of revolution about an axis common to said pusher and said retaining element, said rolling elements being in the form of balls.

8. A device according to claim 1, wherein said retaining element takes the form of a dished member which is concave towards said pusher, a resilient gasket being secured to the inner surface of said sleeve to co-operate with said dished member, said dished member being adapted to bear on a cup urged towards an axial abutment by said resilient means.

9. A device according to claim 8, wherein said resilient abutment means comprise an excess-charge spring, wherein said excess-charge spring bears directly on said dished member to keep said connecting means away from said cup when the engine supplied by the pump is stationary and when it is being started.

10. A device according to claim 1, wherein said inclined surface of said retaining element is a surface of revolution having a generatrix which converges towards a first axial point remote from the governor, and said inclined pusher surface is a surface of revolution having a generatrix which converges towards a second axial point which is also remote from the governor but further away than said first point.

11. A device according to claim 1, wherein said inclined surface of said retaining element is a surface of revolution having a generatrix which converges towards a first axial point remote from the governor, and said inclined pusher surface is a surface of revolution having a generatrix which converges towards a third axial point near the governor.

12. An in-line fuel injection pump for supplying an internal combustion engine, comprising a longitudinally slidable control rod for adjusting the delivery per revolution of the pump, a governor responsive to the speed of the engine, and a regulating device operatively connected to said governor and said control rod to regulate the delivery per revolution of the pump in dependence upon the engine speed, said regulating device comprising a pusher movable by said governor in response to engine speed variations, a sleeve connected to the control rod, means operatively connecting said pusher and said sleeve, and resilient abutment means associated with the governor, said pump being characterised by said pusher having a pusher surface which is inclined to the axial direction of said pusher and by said means operatively connecting the pusher and the sleeve comprising a retaining element on which said sleeve is freely slidable and which has a surface inclined to the pusher axis and convergent with said pusher surface, rolling elements which are disposed between said inclined surface of said retaining element and said pusher surface, and means for transmitting axial movements of said rolling elements to said sleeve, said resilient abutment being adapted to co-operate at one end with said retaining element.

* * * * *